US008282170B2

(12) United States Patent
Lai

(10) Patent No.: US 8,282,170 B2
(45) Date of Patent: Oct. 9, 2012

(54) ADJUSTING STRUCTURE FOR AN ARMREST OF A CHAIR

(76) Inventor: Yu-Shan Lai, Chiayi (TW)

( * ) Notice: Subject to any disclaimer, the term of this patent is extended or adjusted under 35 U.S.C. 154(b) by 175 days.

(21) Appl. No.: 12/915,144

(22) Filed: Oct. 29, 2010

(65) Prior Publication Data

US 2012/0104823 A1 May 3, 2012

(51) Int. Cl.
*A47C 7/54* (2006.01)

(52) U.S. Cl. ..... 297/411.36

(58) Field of Classification Search ..... 297/411.36, 297/353

See application file for complete search history.

(56) References Cited

U.S. PATENT DOCUMENTS 6,585,322 B1 * 7/2003 Lai ..... 297/411.36
6,974,190 B1 * 12/2005 Hung ..... 297/411.36
7,744,159 B2 * 6/2010 Lee ..... 297/411.36
2008/0036264 A1 * 2/2008 Pan ..... 297/411.36
* cited by examiner

*Primary Examiner* — Anthony D Barfield

(74) *Attorney, Agent, or Firm* — Alan Kamrath; Kamrath IP Lawfirm, PA

(57) ABSTRACT

An adjusting structure of an armrest of a chair contains a first body having a bottom plate and a fitting tube; a vertically moving mechanism inserted in the fitting tube and including a second body, an actuating member, a controlling member, and a lip; a retaining mechanism including an engaging member and locking panel inserted in the through hole of the second body; a support element fitted onto the fitting tube and including a cutout to receive a pressing member; a resilient element secured in the support element and one end thereof being biased against an inner side of the support element, and another end of the resilient element abutting against the pressing member and the control end of the controlling member, the pressing member being used to compress the resilient element.

4 Claims, 6 Drawing Sheets

ADJUSTING STRUCTURE FOR AN ARMREST OF A CHAIR

BACKGROUND OF THE INVENTION

1. Field of the Invention

The present invention relates to an armrest of a chair, and more particularly to an adjusting structure of an armrest of a chair.

2. Description of the Prior Art

A conventional office chair includes two support members and two armrests disposed on two sides thereof respectively so that a user is capable of putting hands on the support members individually to achieve comfort. However, the support member and the armrest are integrally injection formed from plastic materials or the support member is made of metal material and then the armrest is connected with the armrest made of plastic materials, therefore such a conventional office chair can not be adjusted its height and angle to satisfy different users' requirements.

Another conventional adjustable height armrest includes a plurality of locking bolts fixed on a middle position of an armrest carrier, accordingly it is not convenient for the user to adjust a height of the armrest.

Also, another conventional office chair armrest is provided to adjust an angle of the armrest and move the armrest frontward and backward, however a height of the armrest is not be adjusted, so the user can not adjust the armrests toward a suitable height to put two hands comfortably.

The present invention has arisen to mitigate and/or obviate the afore-described disadvantages.

SUMMARY OF THE INVENTION

The primary object of the present invention is to provide an adjusting structure of an armrest of a chair that is simplified and adjusted to move upward or downward easily by pressing the pressing member to obtain easy operation.

To obtain the above objectives, an adjusting structure of an armrest of a chair provided by the present invention contains:

a first body having a bottom plate and a fitting tube, and the fitting tube being hollow and including one end removably fixed on the bottom plate, and the bottom plate being coupled with the chair;

a vertically moving mechanism inserted in the fitting tube of the first body, and including a second body, an actuating member, a controlling member, and a lip, the second body including a through hole axially formed thereon, the actuating member including a connecting groove axially arranged on one side thereof, the controlling member including a control end and an abutting end and being disposed in the connecting groove of the actuating member and inserted into the through hole of the second body, and the lip including a slot axially formed thereon and a plurality of positioning recesses horizontally fixed on one side thereof, another side of the lip away from the positioning recesses abutting against the one side of the actuating member away from the connecting groove and being inserted in the through hole;

a retaining mechanism including an engaging member and locking panel inserted in the through hole of the second body, and the locking panel including two axially coupling troughs and an upright column arranged on one side thereof relative to the lip of the vertically moving mechanism, the upright column being fixed in the slot of the lip, and the engaging member including a fixing portion secured on one end thereof and a biasing notch formed on a center of the fixing portion to abut against the abutting end of the controlling member, the engaging member including two joining extensions extending from two sides of another end thereof individually, and each joining extension being axially and rotably disposed in the axially coupling troughs of the locking panel, and the fixing portion being biased against one of the positioning recesses of the lip;

a support element fitted onto the fitting tube and including a cutout to receive a pressing member;

a resilient element secured in the support element and one end thereof being biased against an inner side of the support element, and another end of the resilient element abutting against the pressing member and the control end of the controlling member, the pressing member being used to compress the resilient element.

DETAILED DESCRIPTION OF THE PREFERRED EMBODIMENTS

Figure 1:
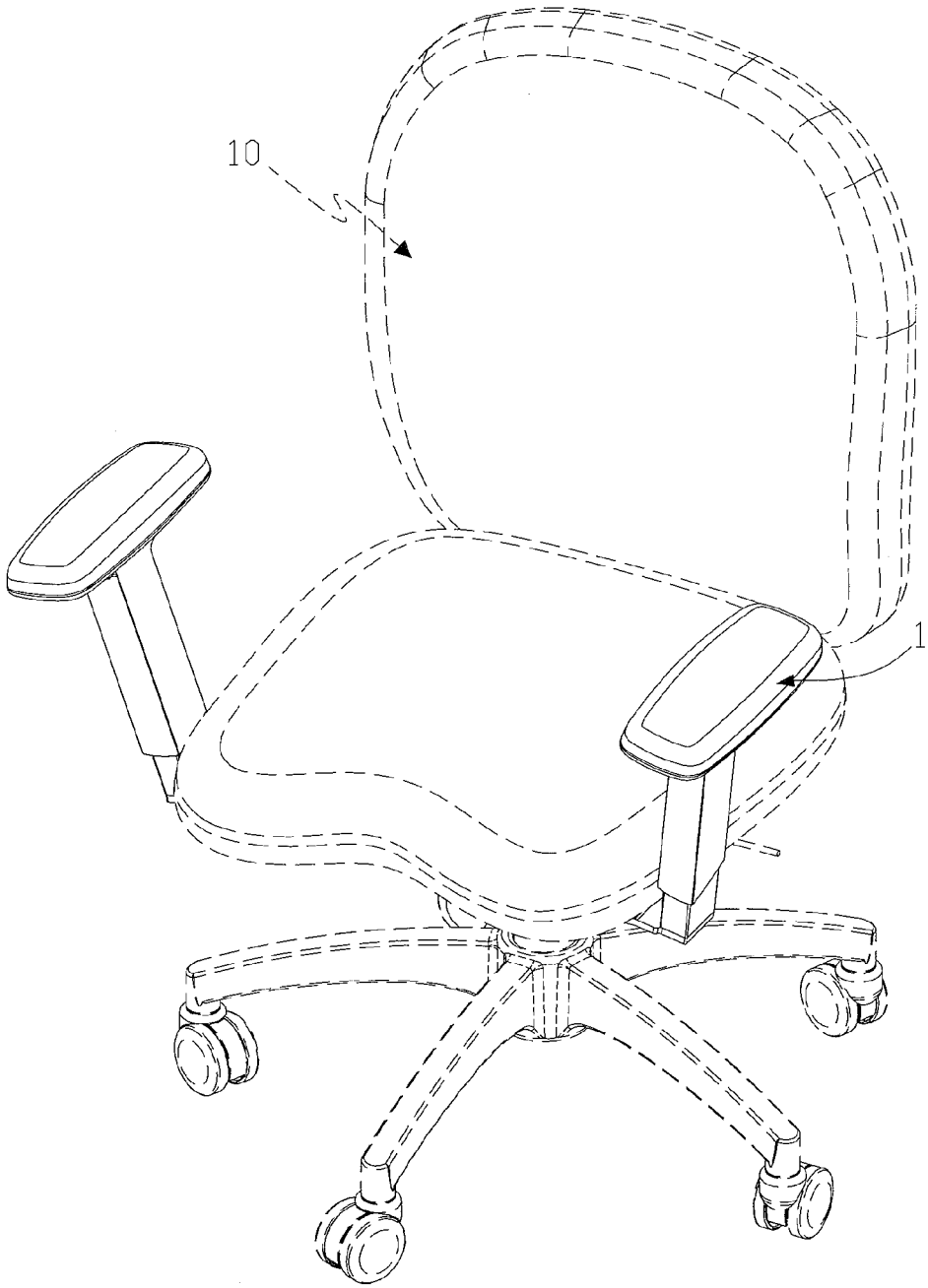
FIG. 1 is a perspective view showing an adjusting structure of an armrest being fixed on a chair according to a preferred embodiment of the present invention.
Figure 2:
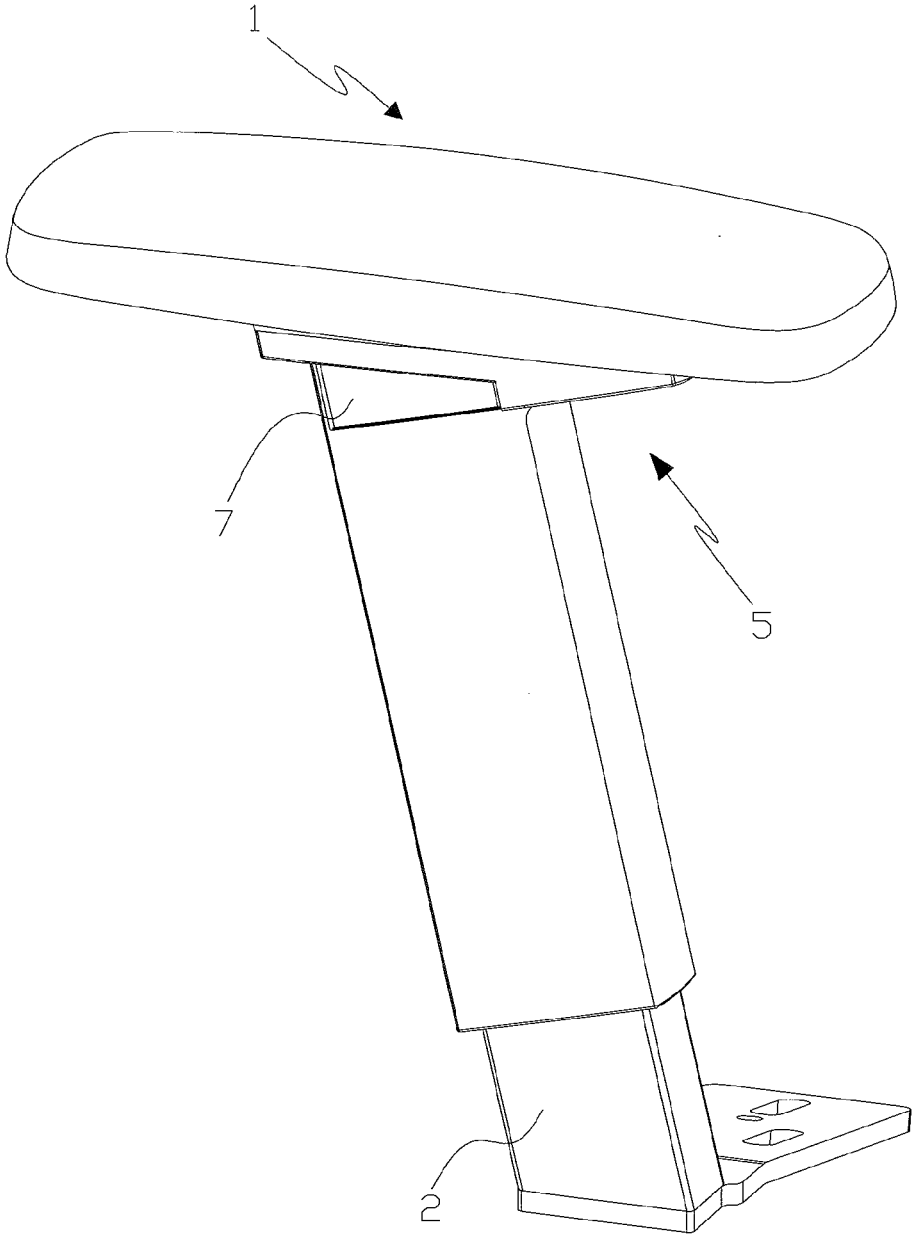
FIG. 2 is a perspective view showing the assembly of the adjusting structure of the armrest of the chair according to the preferred embodiment of the present invention.
Figure 3:
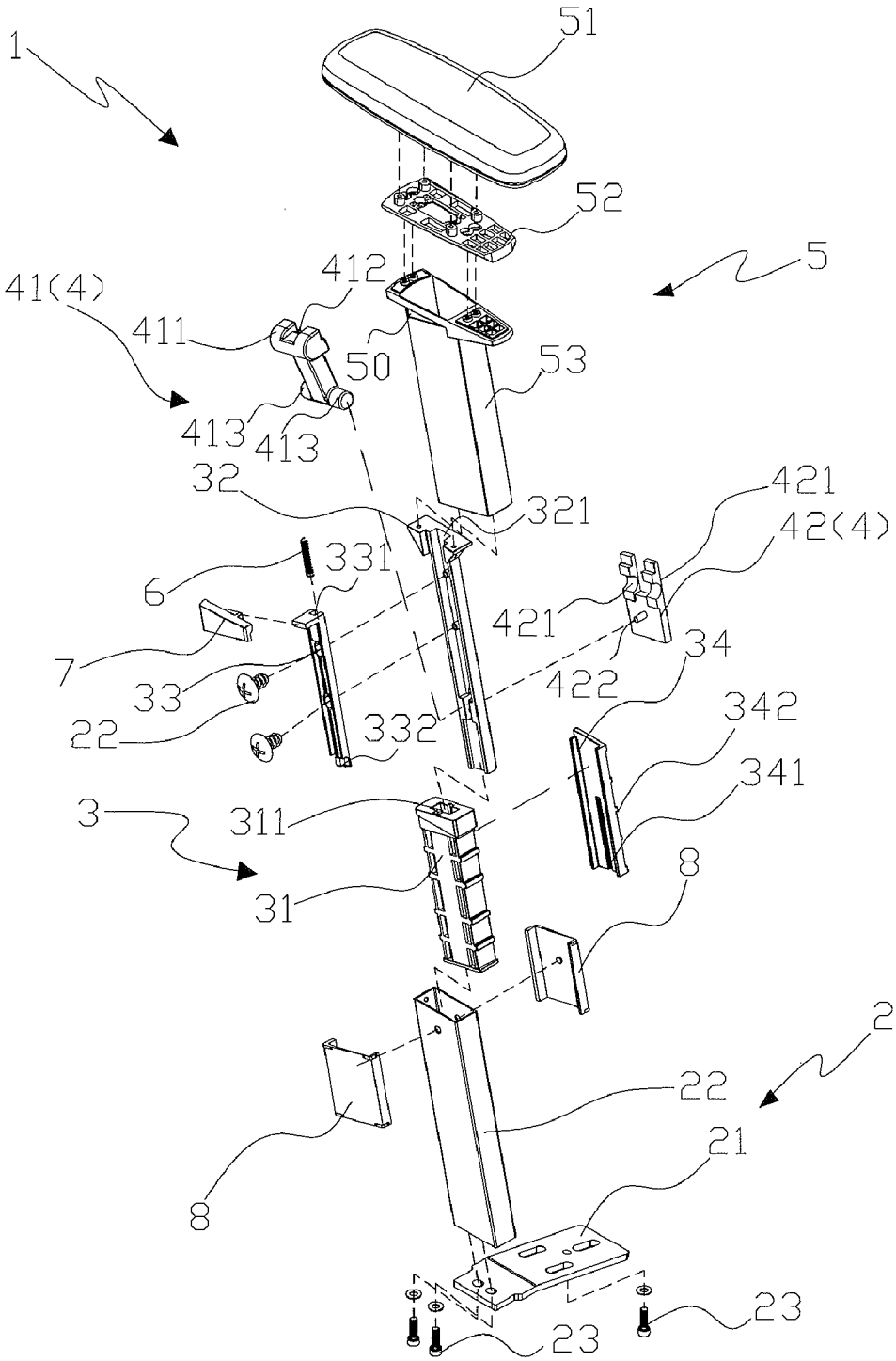
FIG. 3 is a perspective view showing the exploded components of the adjusting structure of the armrest of the chair according to the preferred embodiment of the present invention.

The present invention will be clearer from the following description when viewed together with the accompanying drawings, which show, for purpose of illustrations only, the preferred embodiment in accordance with the present invention.

With reference to FIGS. 1-4, an adjusting structure 1 of an armrest of a chair 10 according to a preferred embodiment of the present invention is fixed on the armrest of each of two sides of the chair 10 to adjust a height when a user puts two hands on the armrests of the chair 10 respectively.

The adjusting structure 1 of the armrest of the chair 10 comprises a first body 2, a vertically moving mechanism 3, a retaining mechanism 4, a support element 5, and a resilient element 6, wherein the resilient element 6 is a compression spring in this embodiment of the present invention, but is not limited to be the compression spring only.

The first body 2 includes a bottom plate 21 and a fitting tube 22, and the bottom plate 21 is removably disposed on the chair 10, the fitting tube 22 is hollow and includes one end removably fixed on the bottom plate 21, the fitting tube 22 is connected with the bottom plate 21 and the bottom plate 21 is coupled with the chair 10 by using at least one first bolt element 23.

The vertically moving mechanism 3 is inserted in the fitting tube 22 of the first body 2, and includes a second body 31, an actuating member 32, a controlling member 33, and a lip 34.

The second body 31 includes a through hole 311 axially formed thereon, the actuating member 32 includes a connecting groove 321 axially arranged on one side thereof, the controlling member 33 includes a control end 331 and an abutting end 332 and is disposed in the connecting groove 321 of the actuating member 32, the actuating member 32 is connected with the actuating member 33 by using the first bolt elements 23, the controlling member 33 and the actuating member 32 are inserted into the through hole 311 of the second body 31, and the lip 34 includes a slot 341 axially formed thereon and a plurality of positioning recesses 342 horizontally fixed on one side thereof, another side of the lip 34 away from the positioning recesses 342 abuts against the one side of the actuating member 32 away from the connecting groove 321 and are inserted in the through hole 311.

The retaining mechanism 4 includes an engaging member 41 and locking panel 42 inserted in the through hole 311 of the second body 31, and the locking panel 42 includes two axially coupling troughs 421 and an upright column 422 arranged on one side thereof relative to the lip 34 of the vertically moving mechanism 3, the upright column 422 is fixed in the slot 341 of the lip 34, and the engaging member 41 includes a fixing portion 411 secured on one end thereof and a biasing notch 412 formed on a center of the fixing portion 411 to abut against the abutting end 332 of the controlling member 33, the engaging member 41 includes two joining extensions 413 extending from two sides of another end thereof individually, and each joining extension 413 is axially and rotably disposed in the axially coupling troughs 421 of the locking panel 42, and the fixing portion 411 is biased against one of the positioning recesses 342 of the lip 34.

The support element 5 is fitted onto the fitting tube 22 and includes a cutout 50 to receive a pressing member 7, and includes a contacting member 51, an upper casing 52, and a lower sleeve 53; the support element 5 is coupled with an upper portion of the lower sleeve 53 by ways of the upper casing 52, and the contacting member 51, the upper casing 52, and the lower sleeve 53 are retained together, the cutout 50 is arranged on a position of the lower sleeve 53 proximate to the upper casing 52, and the lower sleeve 53 is movably fitted onto the fitting tube 22.

The resilient element 6 is secured in the support element 5 and one end thereof is biased against an inner side of the support element 5, e.g., one end of the resilient element 6 is biased against the contacting member 51 and the upper casing 52, and another end of the resilient element 6 abuts against the pressing member 7 and the control end 331 of the controlling member 33, the pressing member 7 is used to compress the resilient element 6.

The adjusting structure 1 further comprises a pair of plugs 8 attached on two sides of the fitting tube 22 and located between the lower sleeve 53 and the fitting tube 22 to reinforce strength of the adjusting structure 1 and to retain the lower sleeve 53 with the fitting tube 22 closely.

Figure 5:
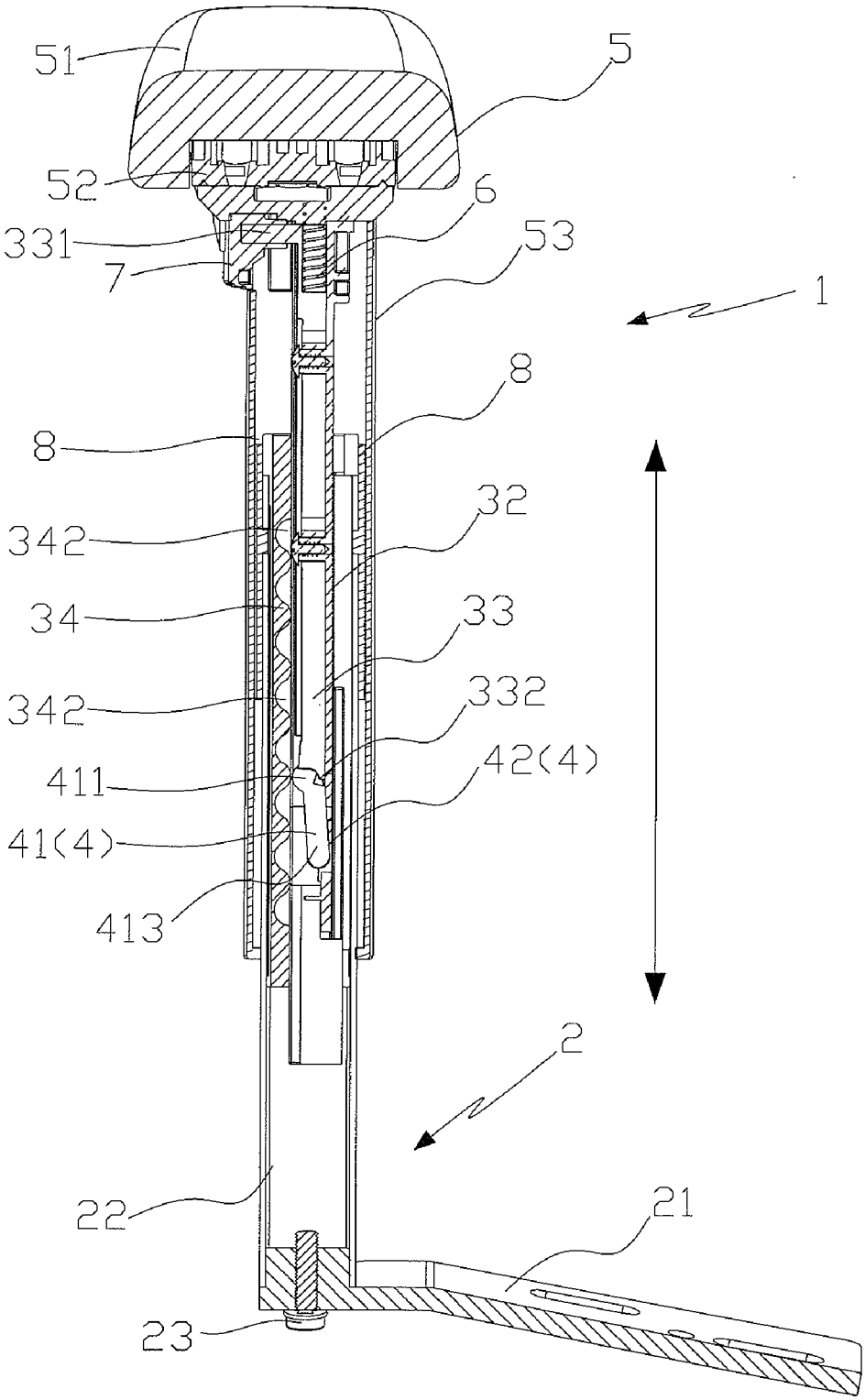
FIG. 5 is a cross sectional view showing the operation of the adjusting structure of the armrest of the chair according to the preferred embodiment of the present invention.
Figure 6:
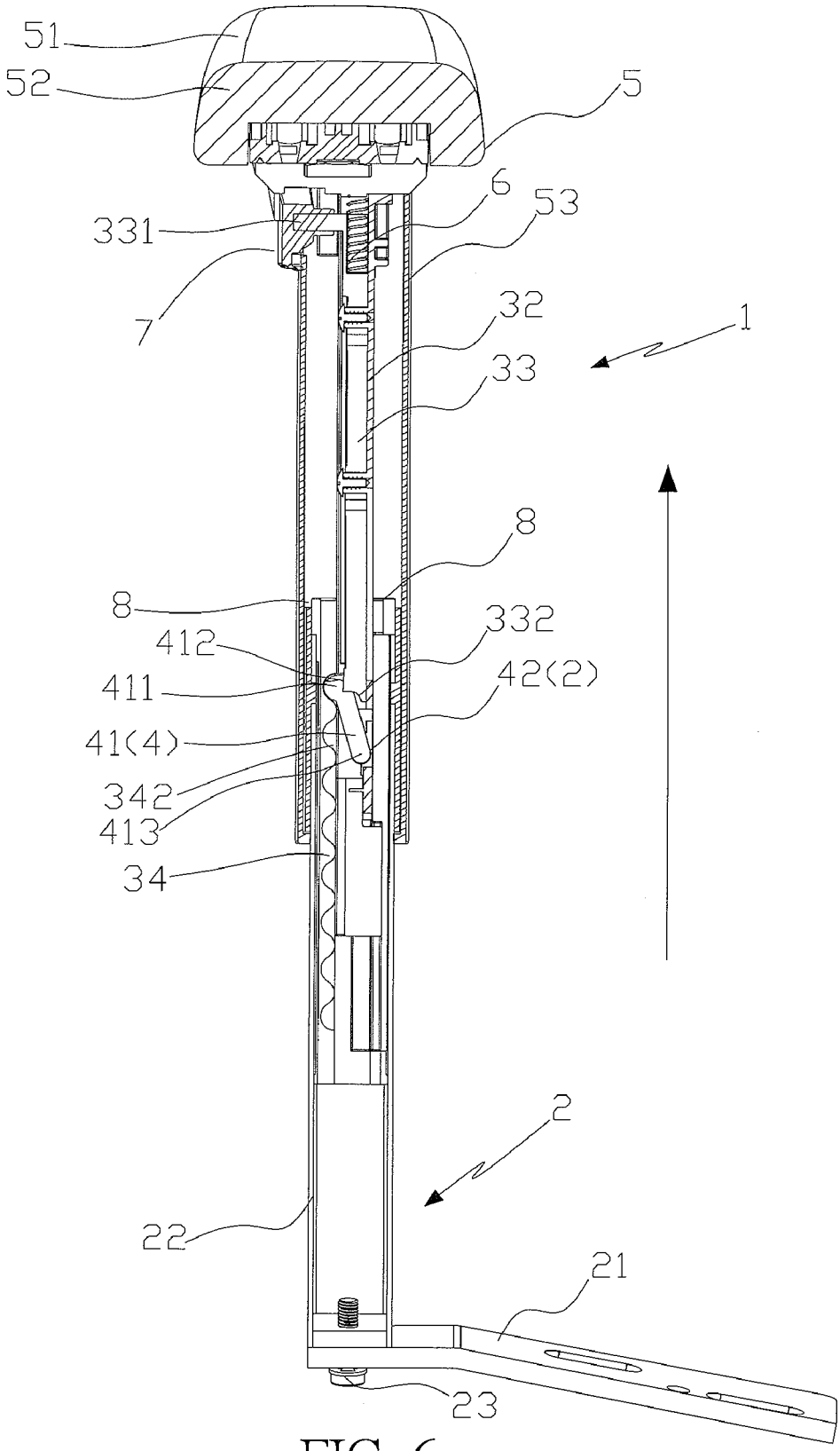
FIG. 6 is another cross sectional view showing the operation of the adjusting structure of the armrest of the chair according to the preferred embodiment of the present invention.

When the armrest is raised by the user as shown in FIG. 6, the pressing member 7 is pressed to compress the resilient element 6 so that the resilient element 6 abuts against one end of the control end 331 of the controlling member 33 and moves away from the control end 331 of the controlling member 33, and the abutting end 332 of the controlling member 33 moves away from the biasing notch 412 of the engaging member 41 so that the fixing portion 411 of the engaging member 41 is moved away from the recess 342 of the lip 34 as illustrated in FIG. 5, thus pulling the armrest upward to a desired height. Thereafter, the pressing member 7 is released so that the resilient element 6 is biased against one side of the control end 331 of the controlling member 33 and then biased against the control end 331 of the controlling member 33, and the abutting end 332 of the controlling member 33 abuts against the biasing notch 412 of the engaging member 41 so that the fixing portion 411 of the engaging member 41 is fixed in the recess 342 which is located at a higher position, thus adjusting the armrest to move upward.

Figure 4:
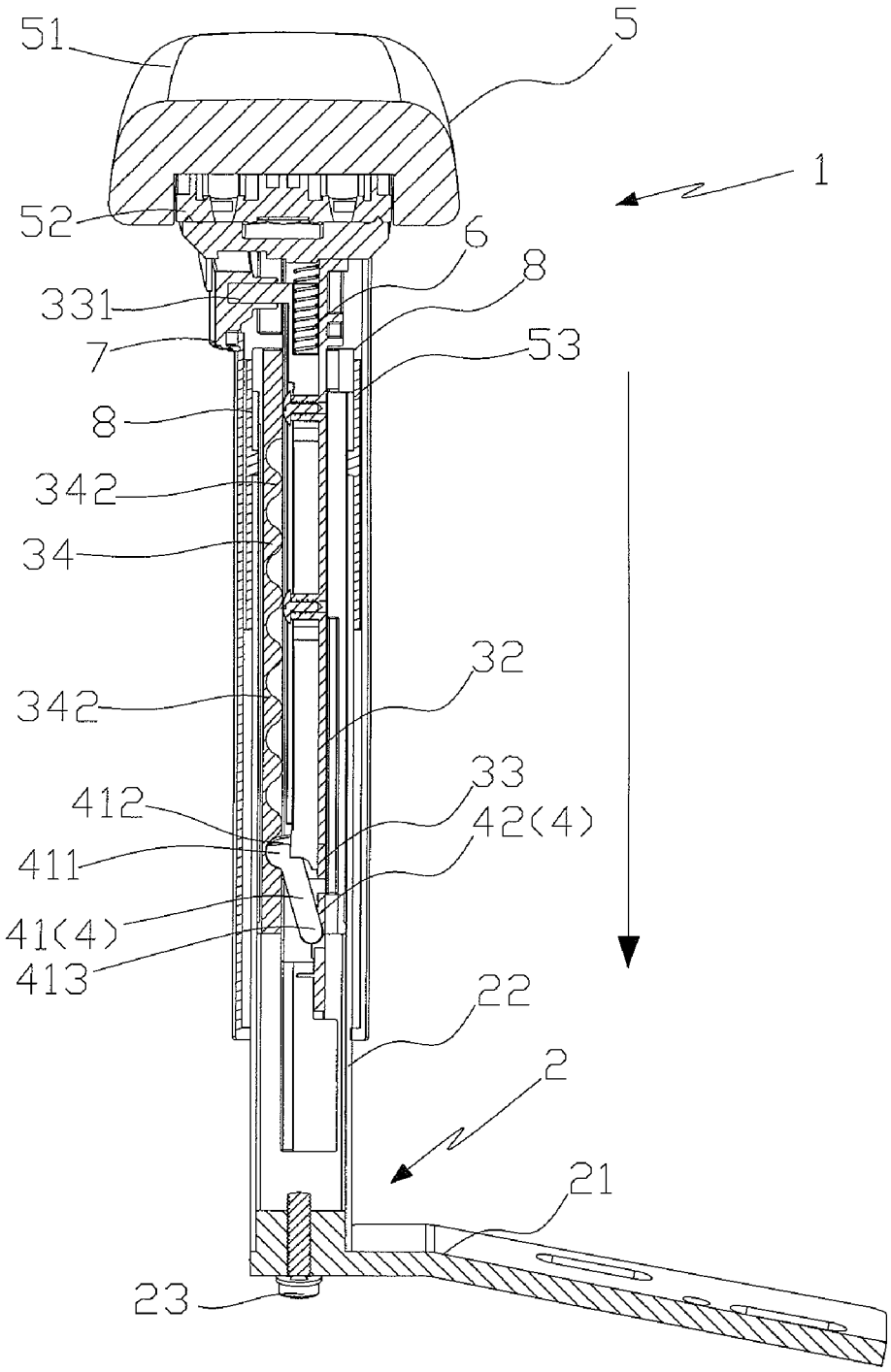
FIG. 4 is a cross sectional view showing the assembly of the adjusting structure of the armrest of the chair according to the preferred embodiment of the present invention.

When the armrest is moved downward by the user as shown in FIG. 4, the pressing member 7 is pressed to compress the resilient element 6 so that the resilient element 6 abuts against the one end of the control end 331 of the controlling member 33 and moves away from the control end 331 of the controlling member 33, and the abutting end 332 of the controlling member 33 moves away from the biasing notch 412 of the engaging member 41 so that the fixing portion 411 of the engaging member 41 is moved away from the recess 342 of the lip 34 as illustrated in FIG. 5, thus pulling the armrest downward to another desired height. Thereafter, the pressing member 7 is released so that the resilient element 6 is biased against the one side of the control end 331 of the controlling member 33 and then biased against the control end 331 of the controlling member 33, and the abutting end 332 of the controlling member 33 abuts against the biasing notch 412 of the engaging member 41 so that the fixing portion 411 of the engaging member 41 is fixed in another recess 342 which is located at a lower position, thus adjusting the armrest to move downward.

Thereby, the adjusting structure of the armrest is simplified and adjusted to move upward or downward easily by pressing the pressing member 7 to obtain easy operation.

While we have shown and described various embodiments in accordance with the present invention, it is clear to those skilled in the art that further embodiments may be made without departing from the scope of the present invention.

What is claimed is:

1. An adjusting structure of an armrest of a chair comprising:

a first body having a bottom plate and a fitting tube, and the fitting tube being hollow and including one end removably fixed on the bottom plate, and the bottom plate being coupled with the chair;

a vertically moving mechanism inserted in the fitting tube of the first body, and including a second body, an actuating member, a controlling member, and a lip, the second body including a through hole axially formed thereon, the actuating member including a connecting groove axially arranged on one side thereof, the controlling member including a control end and an abutting end and being disposed in the connecting groove of the actuating member and inserted into the through hole of the second body, and the lip including a slot axially formed thereon and a plurality of positioning recesses horizontally fixed on one side thereof, another side of the lip away from the positioning recesses abutting against the one side of the actuating member away from the connecting groove and being inserted in the through hole;

a retaining mechanism including an engaging member and locking panel inserted in the through hole of the second body, and the locking panel including two axially coupling troughs and an upright column arranged on one side thereof relative to the lip of the vertically moving mechanism, the upright column being fixed in the slot of the lip, and the engaging member including a fixing portion secured on one end thereof and a biasing notch formed on a center of the fixing portion to abut against the abutting end of the controlling member, the engaging member including two joining extensions extending from two sides of another end thereof individually, and each joining extension being axially and rotably disposed in the axially coupling troughs of the locking panel, and the fixing portion being biased against one of the positioning recesses of the lip;

a support element fitted onto the fitting tube and including a cutout to receive a pressing member;

a resilient element secured in the support element and one end thereof being biased against an inner side of the support element, and another end of the resilient element abutting against the pressing member and the control end of the controlling member, the pressing member being used to compress the resilient element.

2. The adjusting structure of the armrest of the chair as claimed in claim 1, wherein the support element includes a contacting member, an upper casing, and a lower sleeve; the support element is coupled with the lower sleeve by ways of the upper casing, the cutout is arranged on a position of the lower sleeve proximate to the upper casing, and the lower sleeve is movably fitted onto the fitting tube.

3. The adjusting structure of the armrest of the chair as claimed in claim 2 further comprising a pair of plugs attached on two sides of the fitting tube and located between the lower sleeve and the fitting tube.

4. The adjusting structure of the armrest of the chair as claimed in claim 1, wherein the fitting tube is connected with the bottom plate and the bottom plate is coupled with the chair by using at least one first bolt element.

* * * * *